US011819728B1

(12) United States Patent
Mangra

(10) Patent No.: US 11,819,728 B1
(45) Date of Patent: Nov. 21, 2023

(54) COOPERATIVE PAIR EXERCISE APPARATUS

(71) Applicant: Latchman Mangra, Jacksonville, FL (US)

(72) Inventor: Latchman Mangra, Jacksonville, FL (US)

( * ) Notice: Subject to any disclaimer, the term of this patent is extended or adjusted under 35 U.S.C. 154(b) by 73 days.

(21) Appl. No.: 17/929,287

(22) Filed: Sep. 1, 2022

(51) Int. Cl.
*A63B 21/28* (2006.01)
*A63B 21/00* (2006.01)

(52) U.S. Cl.
CPC ..... *A63B 21/28* (2013.01); *A63B 21/4034* (2015.10); *A63B 21/4035* (2015.10); *A63B 21/4045* (2015.10)

(58) Field of Classification Search
CPC . A63B 23/0417; A63B 21/055; A63B 22/203; A63B 23/03533; A63B 69/0022; A63B 21/00061; A63B 21/00065; A63B 21/0442; A63B 21/0552; A63B 21/28; A63B 21/285; A63B 22/0015; A63B 22/14; A63B 23/0355; A63B 2022/0028; A63B 2022/0038; A63B 2208/0204; A63B 2208/0257; A63B 2208/0295; A63B 71/0036; A63B 21/4034; A63B 21/4035; A63B 21/4045
See application file for complete search history.

(56) References Cited

U.S. PATENT DOCUMENTS

| | | | | |
|---|---|---|---|---|
| 5,209,711 | A * | 5/1993 | Scrima | A61H 1/0244 482/70 |
| 5,520,598 | A * | 5/1996 | Little | A63B 21/0615 482/79 |
| 7,294,100 | B2 * | 11/2007 | Bull | A63B 23/1263 482/70 |
| 7,438,673 | B1 * | 10/2008 | Jones | A63B 23/0488 482/907 |
| 7,641,603 | B2 * | 1/2010 | Lacher | A63B 22/203 482/134 |
| 7,850,578 | B2 * | 12/2010 | Balaker | A63B 21/4034 482/131 |
| 10,471,322 | B2 * | 11/2019 | Craig | A63B 69/0002 |
| 11,273,340 | B2 * | 3/2022 | Hohl | A63B 26/003 |
| 2007/0117693 | A1 * | 5/2007 | Ilioi | A63B 21/4035 482/121 |
| 2009/0298655 | A1 * | 12/2009 | Lacher | A63B 22/203 482/134 |
| 2010/0016131 | A1 * | 1/2010 | Hoffman | A63B 21/055 482/121 |
| 2020/0001130 | A1 * | 1/2020 | Schwarz | A63B 21/4034 |

* cited by examiner

*Primary Examiner* — Andrew S Lo
*Assistant Examiner* — Andrew M Kobylarz
(74) *Attorney, Agent, or Firm* — Mark Young, PA

(57) ABSTRACT

An exercise apparatus includes a frame, a pair of opposed seat assemblies, each of which moves between a side and a joint of the base of the frame, a two-sided foot pad assembly that moves between joints of the base of the frame, and a two-sided handlebar assembly that moves along a curved raised section of the frame. A user sits on a seat, places his/her feet on a foot pad of the foot pad assembly, and grabs a facing handlebar. A user may resist or accept motion of the handlebar and foot pad assemblies cause by the other user. Users may take turns in causing such motion.

18 Claims, 9 Drawing Sheets

COOPERATIVE PAIR EXERCISE APPARATUS

FIELD OF THE INVENTION

This invention relates generally to exercise equipment, and, more particularly, to an apparatus configured for two people to use at once, participating together at the same time in a dual action mode, with reciprocal input from each participant.

BACKGROUND OF THE INVENTION

Group exercise has evolved from an individual mimicking movements of an instructor in person to many remote individuals following the directions of an instructor on a video display. While group exercise fosters comradery, it does not require a team effort. Each individual performs the exercise without physical input from any other participant.

Team building exercises have been devised to foster teamwork. An example include lifting and moving a heavy load, such as a log, which is a training exercise routinely performed by military teams. Another example is a team obstacle course event that requires team members to support each other as they scale an inclined wall slicked with grease or mud.

While group and team building exercises are useful for their intended purpose, they do not provide an opportunity for two participants to cooperatively engage in an exercise regimen that necessitates continuous reciprocal input from a partner.

An exercise apparatus that is particularly suitable for two people to use at once, participating together at the same time in a dual action mode, each person providing reciprocal input (e.g., pulling while the other is pushing), to support each other, is needed for fitness, physical therapy, occupational therapy, team building, and personal bonding.

The invention is directed to overcoming one or more of the problems and solving one or more of the needs as set forth above.

SUMMARY OF THE INVENTION

To solve one or more of the problems set forth above, in an exemplary implementation of the invention, an exercise apparatus includes a frame, a pair of opposed seat assemblies, each of which moves between a side and a joint of the base of the frame, a two-sided foot pad assembly that moves between joints of the base of the frame, and a two-sided handlebar assembly that moves along a curved raised section of the frame. A user sits on a seat, places his/her feet on a foot pad of the foot pad assembly, and grabs the facing handlebar of the handlebar assembly. As one user urges a handlebar in the other user's direction, the other user may pull a handlebar towards himself/herself. A user may provide resistance to movement of the handlebar by the other user. Alternatively, a user may cooperate with the movement urged by the other user. Concomitantly, as one user extends his/her legs, the foot pad assembly is pushed towards the other user. A user may provide resistance to movement of the foot pad assembly by the other user. Alternatively, a user may cooperate with the movement urged by the other user.

An exemplary two-person exercise machine according to principles of the invention includes a pair of base rails. The base rails include a first base rail and a second base rail. The first base rail is parallel to the second base rail. Two seat assemblies are movably supported by the pair of base rails.

A first seat assembly is movable along at least a first portion of the pair of base rails. A second seat assembly is movable along at least a second portion of the pair of base rails. The second portion of the pair of base rails is spaced apart from the first portion of the pair of base rails. A foot pad assembly is supported by the pair of bottom rails between the first seat assembly and the second seat assembly. The foot pad assembly includes a first foot pad facing the first seat assembly and a second foot pad facing the second seat assembly. The foot pad assembly is movable along at least an intermediate portion of the pair of base rails between the first seat assembly and the second seat assembly. The first foot pad and the second foot pad are each at an acute angle relative to a plane bisecting the foot pad assembly. In one embodiment, a first angle of the first foot pad relative to the plane bisecting the foot pad assembly and a second angle of the second foot pad relative to the plane bisecting the foot pad assembly are complementary.

A plurality of base rail supports may support the pair of base rails at an elevation, the elevation of the first base rail being equal to the elevation of the second base rail. The plurality of base rail supports may include a first end bracket attached at a first end of the pair of bottom rails and a second end bracket attached at a second end of the pair of bottom rails. The first end is opposite the second end. The first end bracket prevents movement of the first seat assembly beyond the first end. The second end bracket prevents movement of the second seat assembly beyond the second end.

A pair of upper rails is provided. A first upper rail is parallel to the second upper rail. The pair of upper rails is supported at an upper elevation. The first pair of rail supports extends from the pair of base rails to a first end of the pair of upper rails. A second pair of rail supports extends from the pair of base rails to a second end of the pair of upper rails. The first pair of rail supports extends from the pair of base rails between the first end of the pair of base rails and the foot pad assembly. The second pair of rail supports extends from the pair of base rails between the second end of the pair of base rails and the foot pad assembly.

A handlebar assembly is supported by the pair of upper rails between the first end of the pair of upper rails and the second end of the pair of upper rails. The handlebar assembly includes a first handlebar facing the first end of the pair of upper rails and a second handlebar facing the second end of the pair of upper rails. The handlebar assembly is movably supported by the pair of upper rails. The handlebar assembly is movable between the first end of the pair of upper rails and the second end of the pair of upper rails. The first and second upper rails are arcuate. The first seat assembly includes a first plurality of rollers configured to engage and roll against the first base rail. The first seat assembly also includes a second plurality of rollers configured to engage and roll against the second base rail. The second seat assembly includes a third plurality of rollers configured to engage and roll against the first base rail. The second seat assembly also includes a fourth plurality of rollers configured to engage and roll against the second base rail. Each of the first and third plurality of rollers include upper and lower rollers. The upper rollers of the first and third plurality of rollers engage and roll against the first base rail. The lower rollers of the first and third plurality of rollers engage and roll against the first base rail. The first base rail is disposed between the upper and lower rollers of the first and third plurality of rollers. Each of the second and fourth plurality of rollers include upper and lower rollers. The upper rollers of the second and fourth plurality of rollers engage and roll against the second base rail. The lower rollers of the second and fourth plurality of rollers engage and roll against the second base rail. The second base rail is disposed between the upper and lower rollers of the second and fourth plurality of rollers.

The foot pad assembly includes a fifth plurality of rollers configured to engage and roll against the first base rail. The foot pad assembly also includes a sixth plurality of rollers configured to engage and roll against the second base rail. Each of the fifth and sixth plurality of rollers includes upper and lower rollers. The upper rollers of the fifth plurality of rollers engage and roll against the first base rail. The lower rollers of the fifth plurality of rollers engage and roll against the first base rail. The first base rail is disposed between the upper and lower rollers of the fifth plurality of rollers. The upper rollers of the sixth plurality of rollers engage and roll against the second base rail. The lower rollers of the sixth plurality of rollers engage and roll against the second base rail. The second base rail is disposed between the upper and lower rollers of the sixth plurality of rollers.

The handlebar assembly includes a seventh plurality of rollers configured to engage and roll against the first upper rail. The handlebar assembly also includes an eighth plurality of rollers configured to engage and roll against the second upper rail. Each of the seventh and eighth plurality of rollers includes upper and lower rollers. The upper rollers of the seventh plurality of rollers engage and roll against the first upper rail. The lower rollers of the seventh plurality of rollers engage and roll against the first upper rail. The first upper rail is disposed between the upper and lower rollers of the seventh plurality of rollers. The upper rollers of the eighth plurality of rollers engage and roll against the second upper rail. The lower rollers of the eighth plurality of rollers engage and roll against the second upper rail. The second upper rail is disposed between the upper and lower rollers of the eighth plurality of rollers.

Each of the first base rail, the second base rail, the first upper rail and the second upper rail may be comprised of tubular metal (e.g., tubular steel or aluminum).

Each of the first, second, third, fourth, fifth, sixth, seventh and eighth plurality of rollers may comprise u-groove plastic (e.g., nylon) rollers.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

An exercise apparatus according to principles of the invention includes a frame, a pair of opposed seat assemblies, each of which moves between a side and a joint of the base of the frame, a two-sided foot pad assembly that moves between joints of the base of the frame, and a two-sided handlebar assembly that moves along a curved raised section of the frame. A user sits on a seat, places his/her feet on a foot pad of the foot pad assembly, and grabs the facing handlebar of the handlebar assembly. As one user urges a handlebar in the other user's direction, the other user may pull a handlebar towards himself/herself. A user may provide resistance to movement of the handlebar by the other user. Alternatively, a user may cooperate with the movement urged by the other user. Concomitantly, as one user extends his/her legs, the foot pad assembly is pushed towards the other user. A user may provide resistance to movement of the foot pad assembly by the other user. Alternatively, a user may cooperate with the movement urged by the other user.

Figure 8:
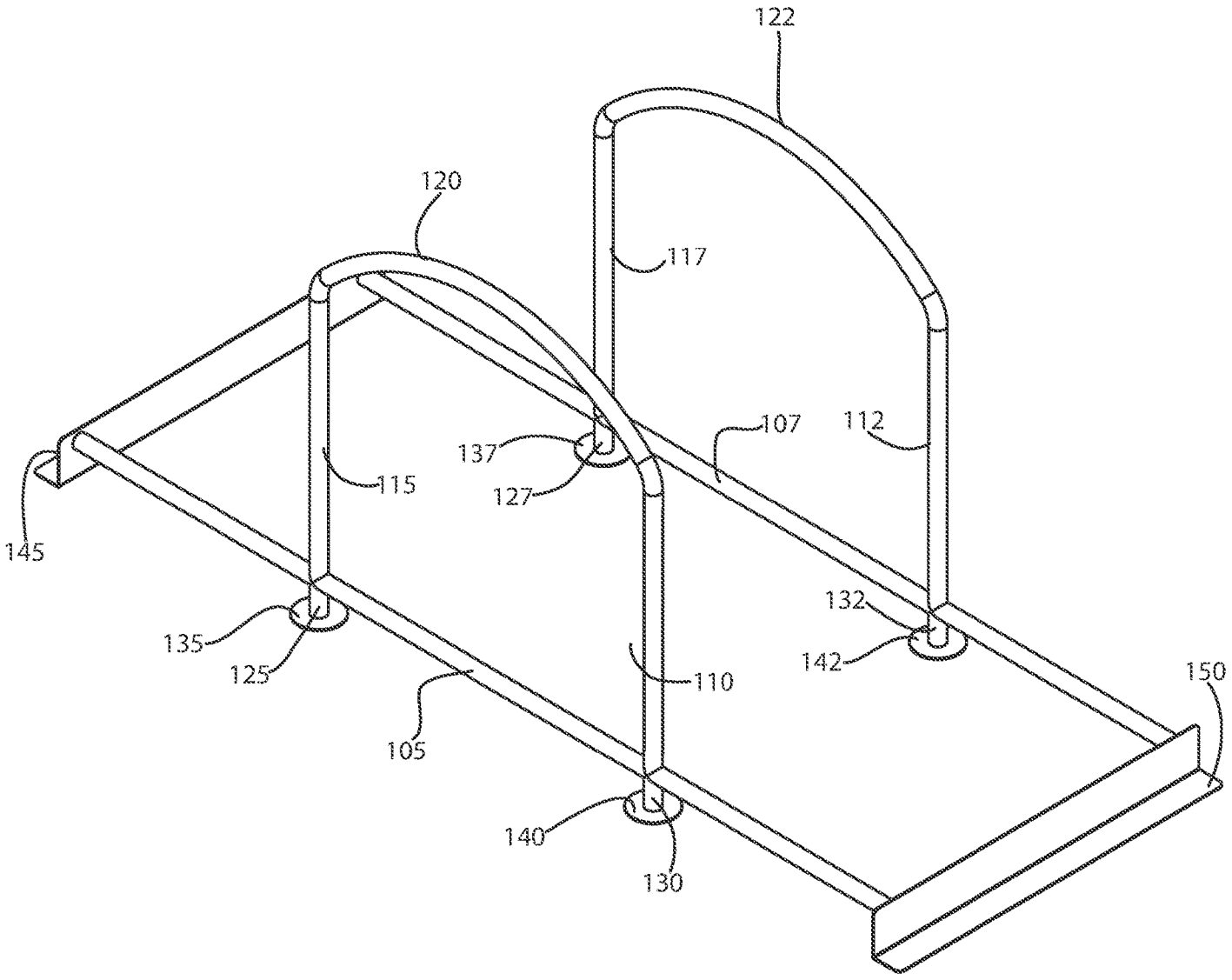
FIG. 8 is a perspective view of a frame assembly for an exemplary exercise apparatus according to principles of the invention.

FIGS. 1-4 conceptually illustrate an exemplary exercise apparatus according to principle of the invention. The apparatus 100 includes a frame comprised of joined metal tubes. The frame, as shown alone in FIG. 8, includes a pair of parallel spaced-apart base rails 105, 107 that extend between end base brackets 145, 150. Each rail 105, 107 is a tubular metal structure with a circular cross-section. The rails 105, 107 are equal in size. Each end base bracket 145, 150 is a structural metal angle with an L-shaped cross section, including a leg with a height that exceeds the diameter of the rail 105, 107. The end base bracket, support legs 125, 127, 130, 132 and feet 135, 137, 140, 142, support the rails 105, 107 above and parallel to a level floor. A generally U-shaped rail structure comprises a pair of upper rails 120, 122, and a pair of rail supports 110, 115, 112, 117 extending from each end of each upper rail 120, 122 to each base rail 105, 110. The U-shaped rail structures are aligned, parallel and spaced apart.

Figure 1:
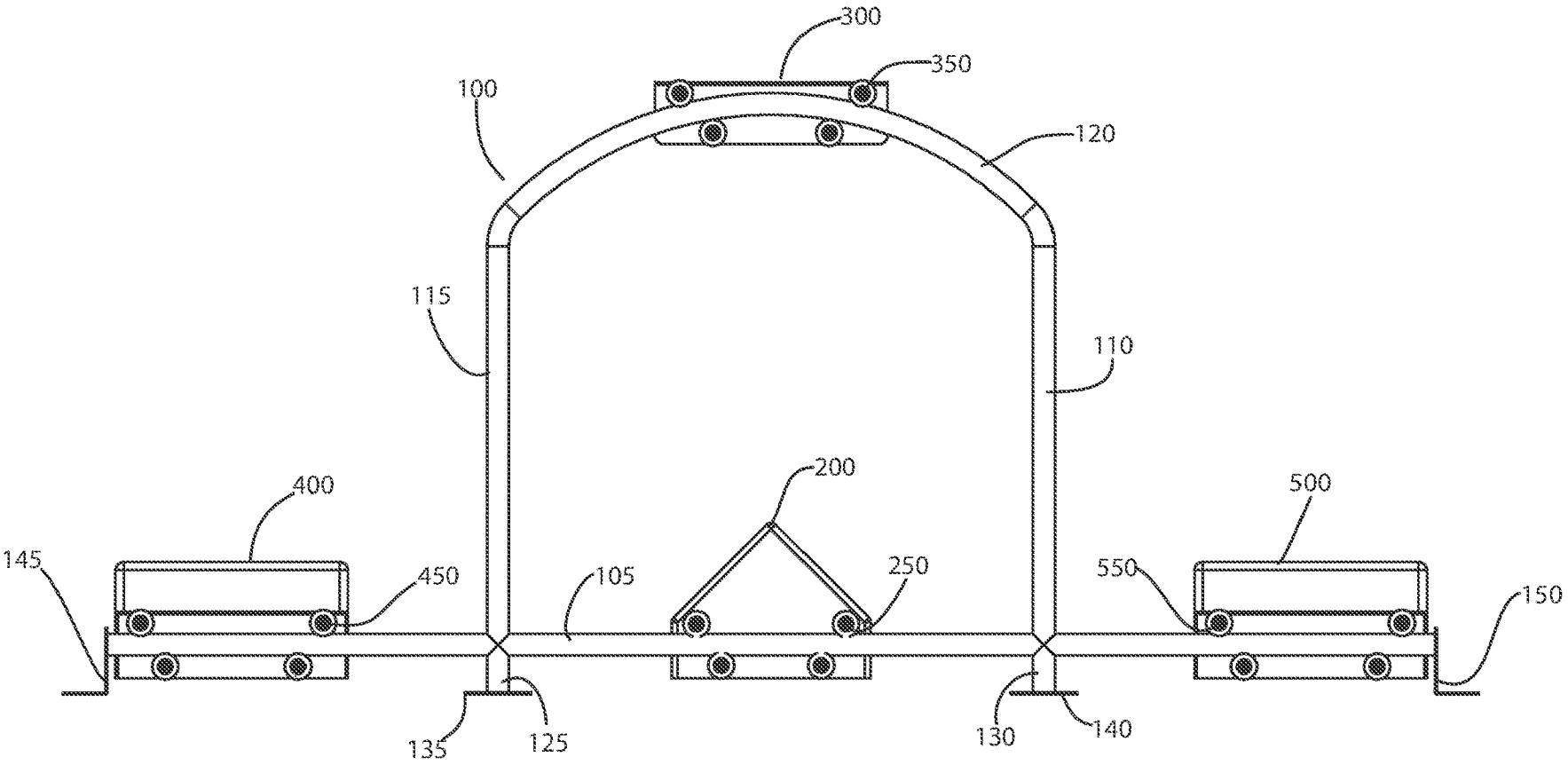
FIG. 1 is a front view of an exemplary exercise apparatus according to principles of the invention.
Figure 2:
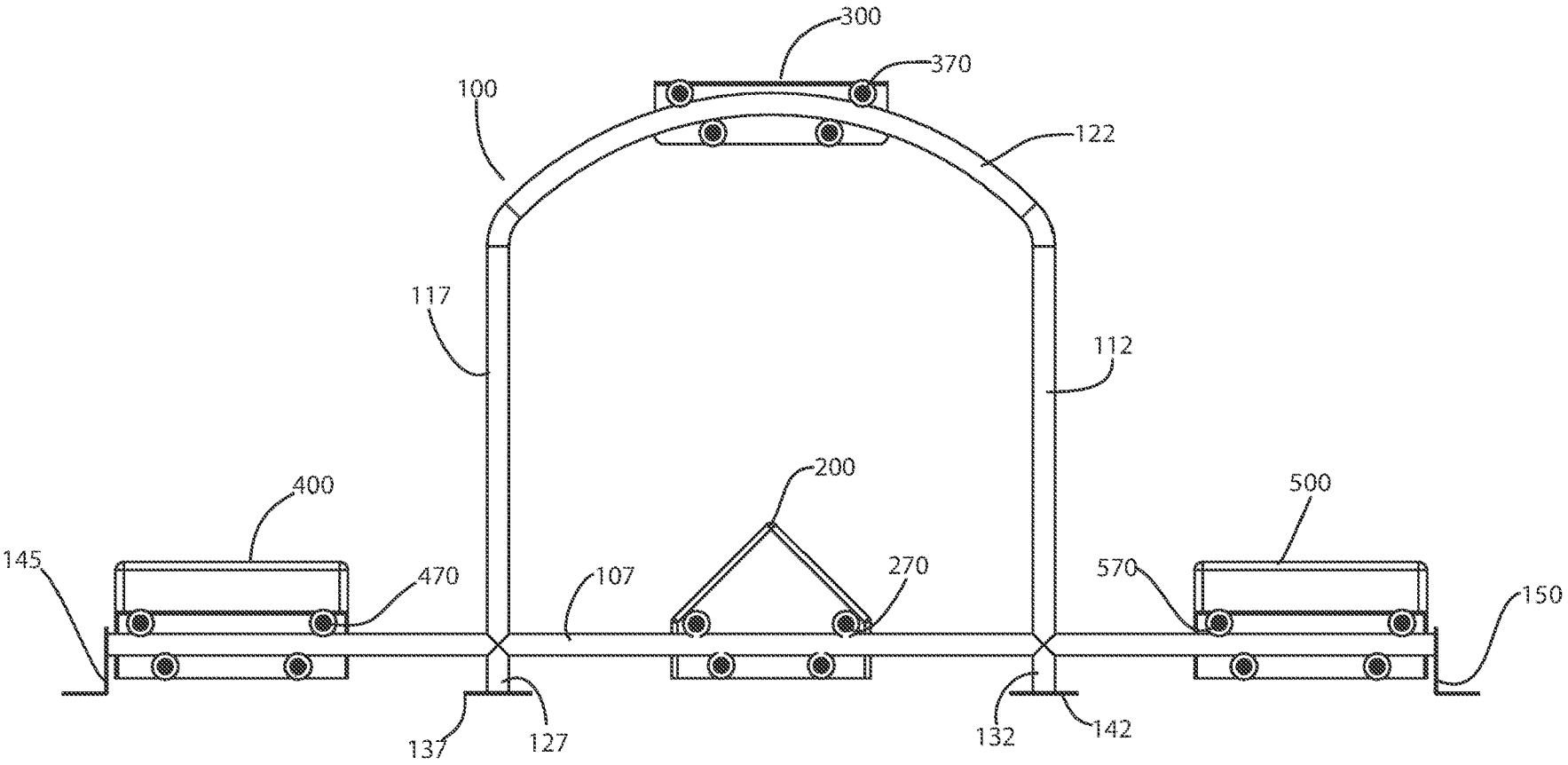
FIG. 2 is rear view of an exemplary exercise apparatus according to principles of the invention.
Figure 3:
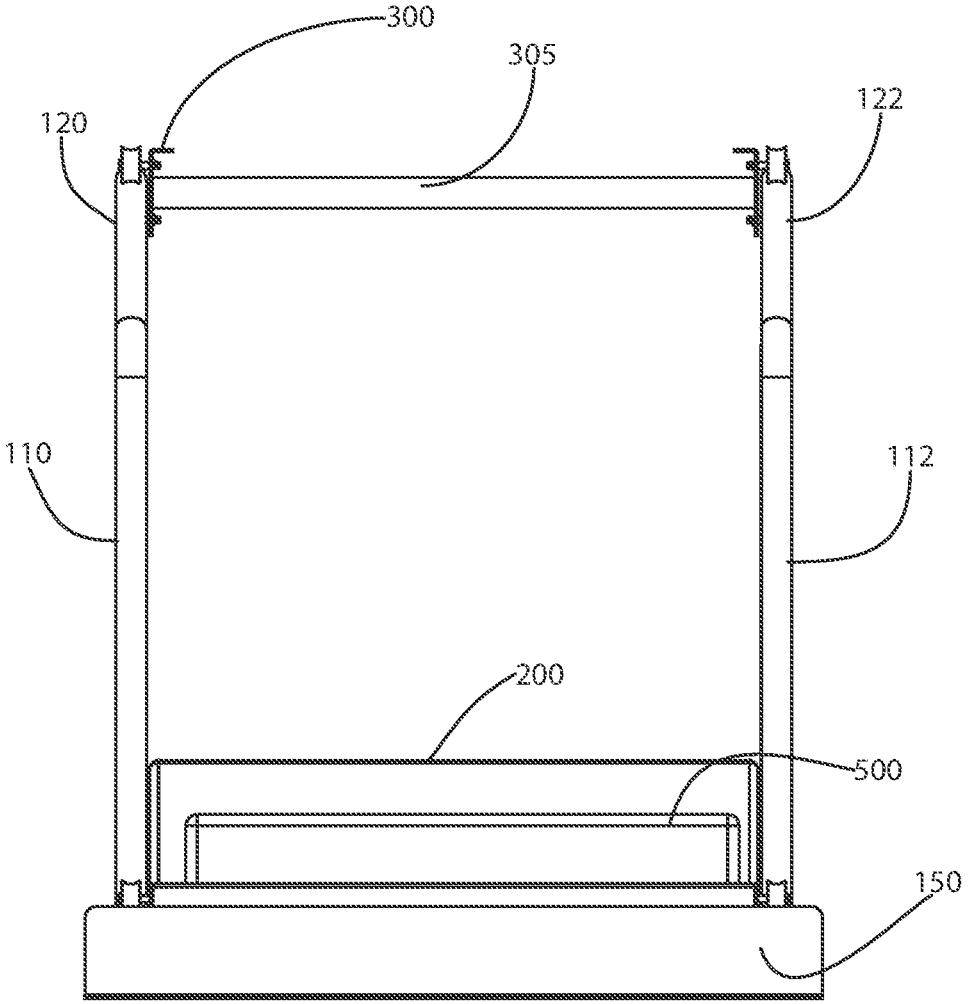
FIG. 3 is side view of an exemplary exercise apparatus according to principles of the invention.
Figure 4:
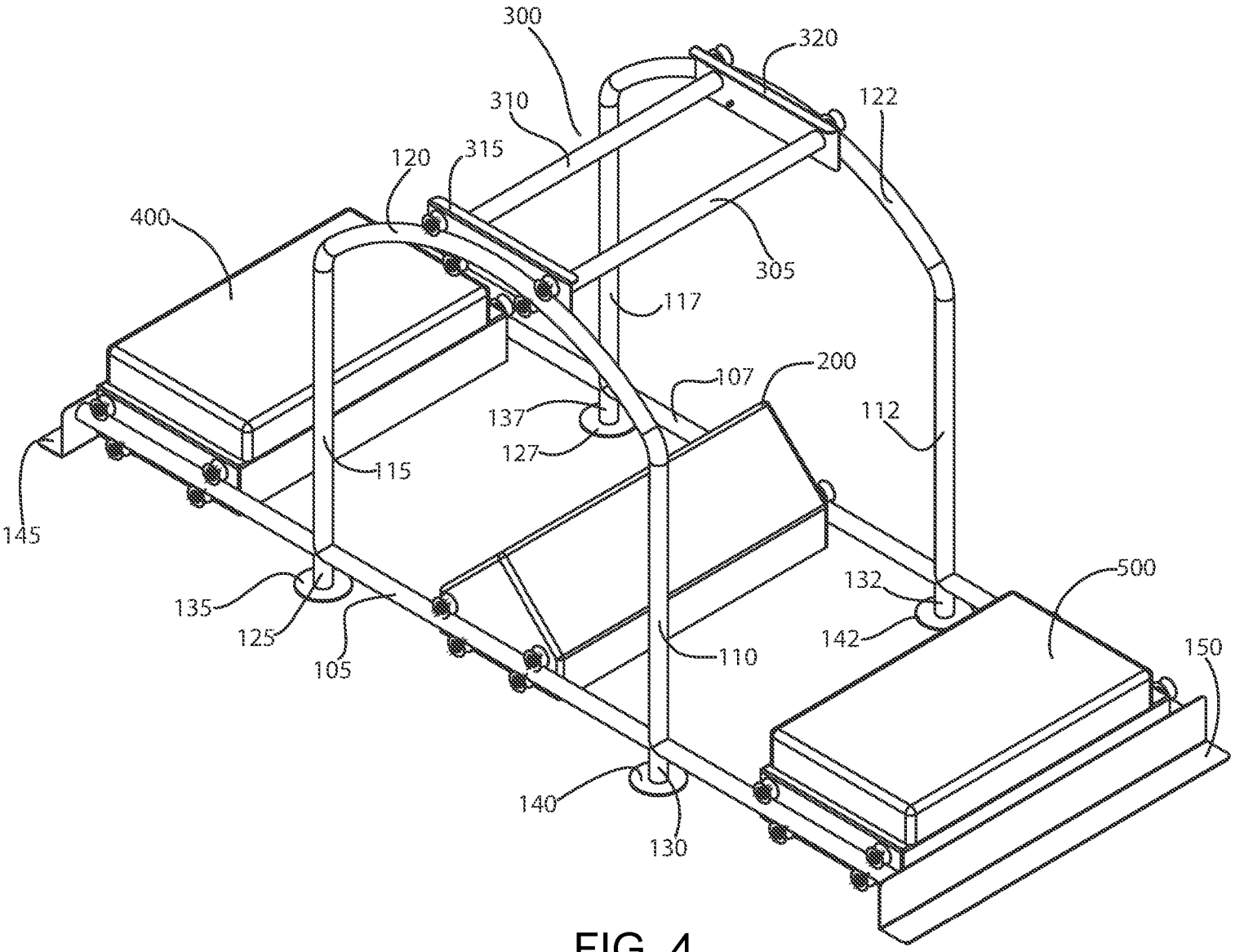
FIG. 4 is perspective view of an exemplary exercise apparatus according to principles of the invention.
Figure 5:
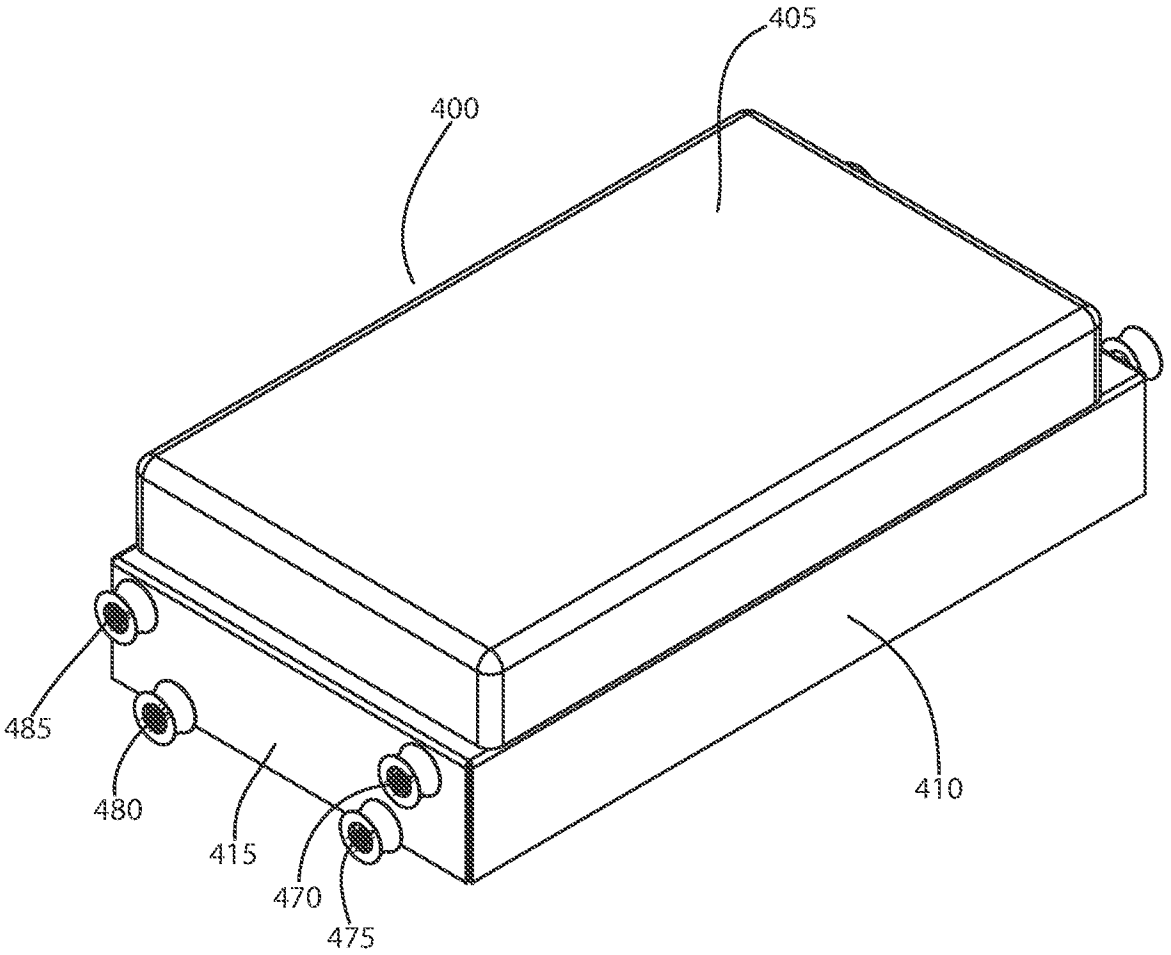
FIG. 5 is a perspective view of a seat assembly for an exemplary exercise apparatus according to principles of the invention.

A plurality of movable assemblies are provided. The movable assemblies provide seating and structures for pulling or pushing by each user. Two seat assemblies 400, 500 are provided, on opposite sides of the U-shaped rail structures. The seat assemblies 400, 500 are identical. As shown in FIG. 5, each seat assembly 400 includes a base 405 and a seat cushion 410 mounted on the base 405. Four rollers 470-485 are mounted on each side panel 415. The side panel opposite to side panel 415, and rollers mounted on that opposite side panel, are identical to side panel 415 and the rollers 470-485 mounted on side panel 415. Each set of four rollers 470-485 is arranged to engage a base rail 105, 107. Each roller 470-485 has a U-shaped groove. The rollers are positioned to receive a base rail 105, 107 between upper rollers 470, 485 and lower rollers 475, 480. Such an arrangement allows sliding/rolling motion along the base rail 105, 107, while preventing removal of the seat assembly 400, 500 from the apparatus. While four rollers per side are shown, the invention is not limited to four rollers. Fewer or additional rollers may be used without departing from the scope of the invention.

Each seat assembly 400, 500 may move along the rails 105, 107 between an end base bracket 145, 150 and the joint formed at the intersection of the rail supports 110, 115, 112, 117 and the base rail 105, 107. A seated user may grip a handle 305, 310 of the handlebar assembly 300 to pull or push his/her seat assembly 400, 500 towards or away from the joint, provided the other user supports such movement. If users push against opposite foot pads of the foot pad assembly 200, they may urge their seat assembly 400, 500, to the end base bracket 145, 150. The seat assemblies 400, 500 cannot travel on the base rails 105, 107 beyond the end base brackets 145, 150.

Figure 6:
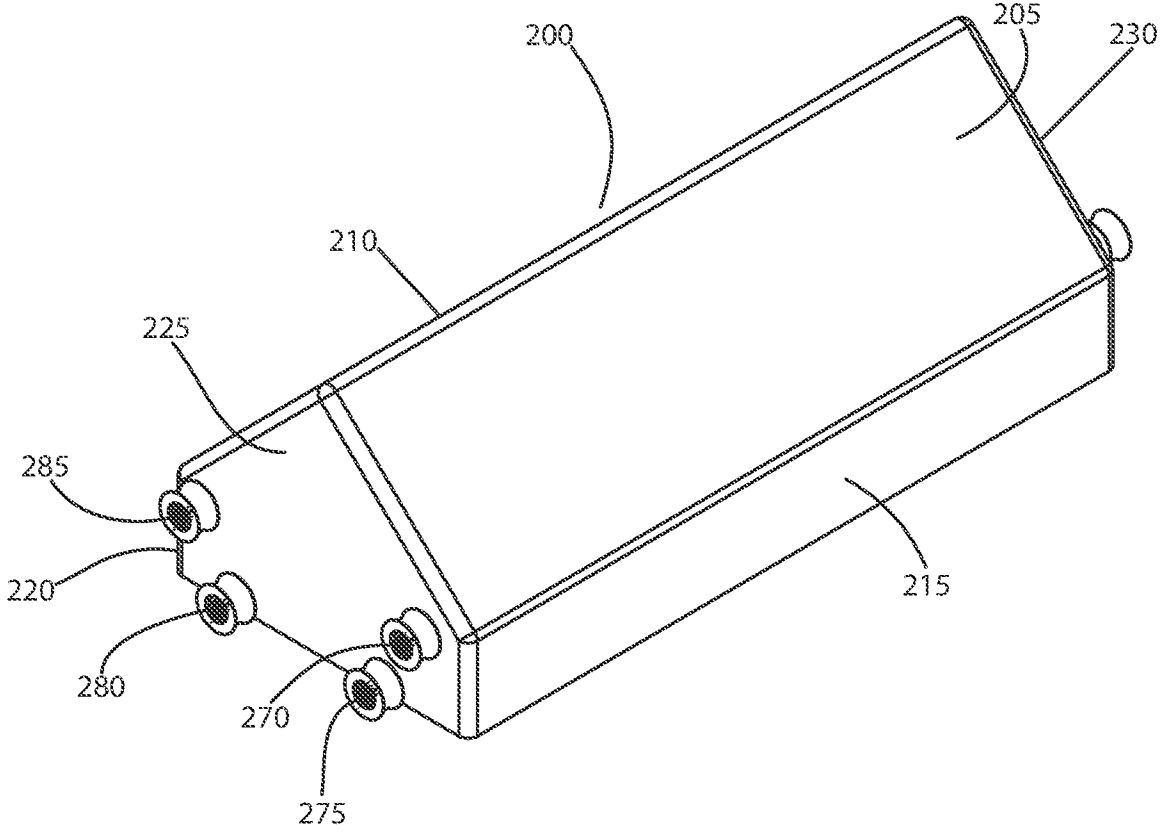
FIG. 6 is a perspective view of a foot pad assembly for an exemplary exercise apparatus according to principles of the invention.

A foot pad assembly 200 (FIG. 6) includes a pair of oblique foot pads 205, 210, that converge at their top. The foot pads 205, 210 are mounted on a base 215. Four rollers 270-285 are mounted on each side panel 220. The side panel 230 opposite to side panel 220, and rollers mounted on that opposite side panel, are identical to side panel 220 and the rollers 270-285 mounted on side panel 220. Each set of four rollers 270-285 is arranged to engage a base rail 105, 107. Each roller 270-285 has a U-shaped groove. The rollers are positioned to receive a base rail 105, 107 between upper rollers 270, 285 and lower rollers 275, 280. Such an arrangement allows sliding/rolling motion along the base rail 105, 107, while preventing removal of the foot pad assembly 200 from the apparatus 100. While four rollers per side are shown, the invention is not limited to four rollers. Fewer or additional rollers may be used without departing from the scope of the invention.

The foot pad assembly 200 may move along the rails 105, 107 between the joints formed at the intersection of the rail supports 110, 115, 112, 117 and the base rail 105, 107. A seated user may extend or bend his/her legs to push against or cease pushing against a foot pad 205, 210 of the foot pad assembly 200. Users may push against opposite foot pads 205, 210 of the foot pad assembly 200. One user may push, while the other bends his or her legs to allow movement of the assembly 200 in that user's direction. The foot pad assembly 200 cannot travel on the base rails 105, 107 beyond the joints formed at the intersection of the rail supports 110, 115, 112, 117 and the base rail 105, 107.

Figure 7:
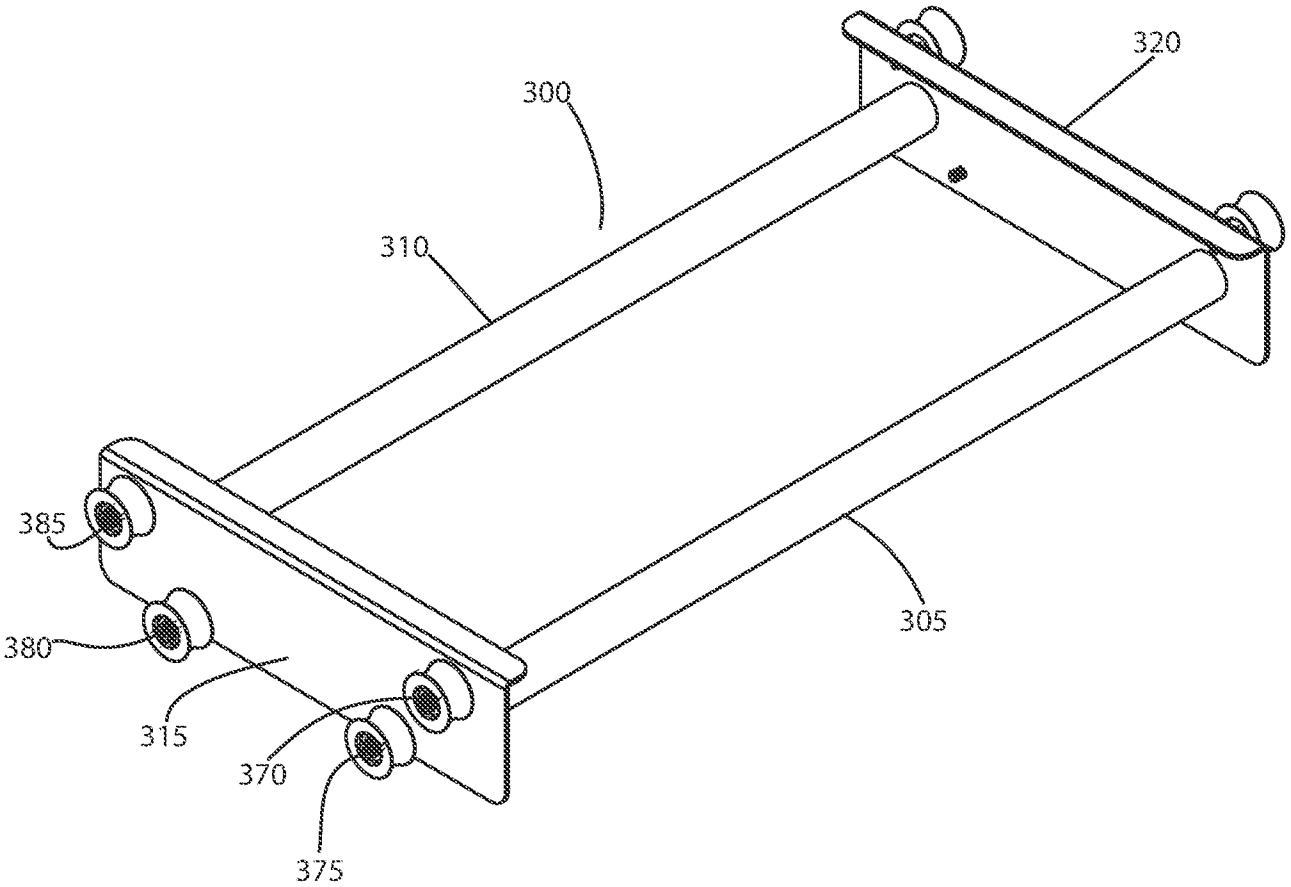
FIG. 7 is a perspective view of a handlebar assembly for an exemplary exercise apparatus according to principles of the invention.

A handlebar assembly 300 (FIG. 7) includes a pair of handlebars 305, 310, that extend between side panels 315, 320 to which rollers 370-385 are mounted. Four rollers 370-385 are mounted on each side panel 315, 320. The side panel 320 opposite to side panel 315, and rollers mounted on that opposite side panel, are identical to side panel 320 and the rollers 370-385 mounted on side panel 320. Each set of four rollers 370-385 is arranged to engage an upper rail 120, 122. Each roller 370-385 has a U-shaped groove. The rollers are positioned to receive an upper rail 120, 122 between upper rollers 370, 385 and lower rollers 375, 380. Such an arrangement allows sliding/rolling motion along the upper rail 120, 122, while preventing removal of the handlebar assembly 300 from the apparatus 100. While four rollers per side are shown, the invention is not limited to four rollers. Fewer or additional rollers may be used without departing from the scope of the invention.

The handlebar assembly 300 may move along the rails 120, 122 between the joints formed at the intersection of the rail supports 110, 115, 112, 117 and the upper rails 120, 122. A seated user may extend or bend his/her arms to push against or cease pushing against a handlebar 305, 310 of the handlebar assembly 300. Users may push against opposite handlebars 305, 310 of the handlebar assembly 300. One user may push, while the other bends his or her arms to allow movement of the assembly 300 in that user's direction. The foot pad assembly 300 cannot travel on the upper rails 120, 122 beyond the joints formed at the intersection of the rail supports 110, 115, 112, 117 and the upper rails 120, 122.

Figure 9:
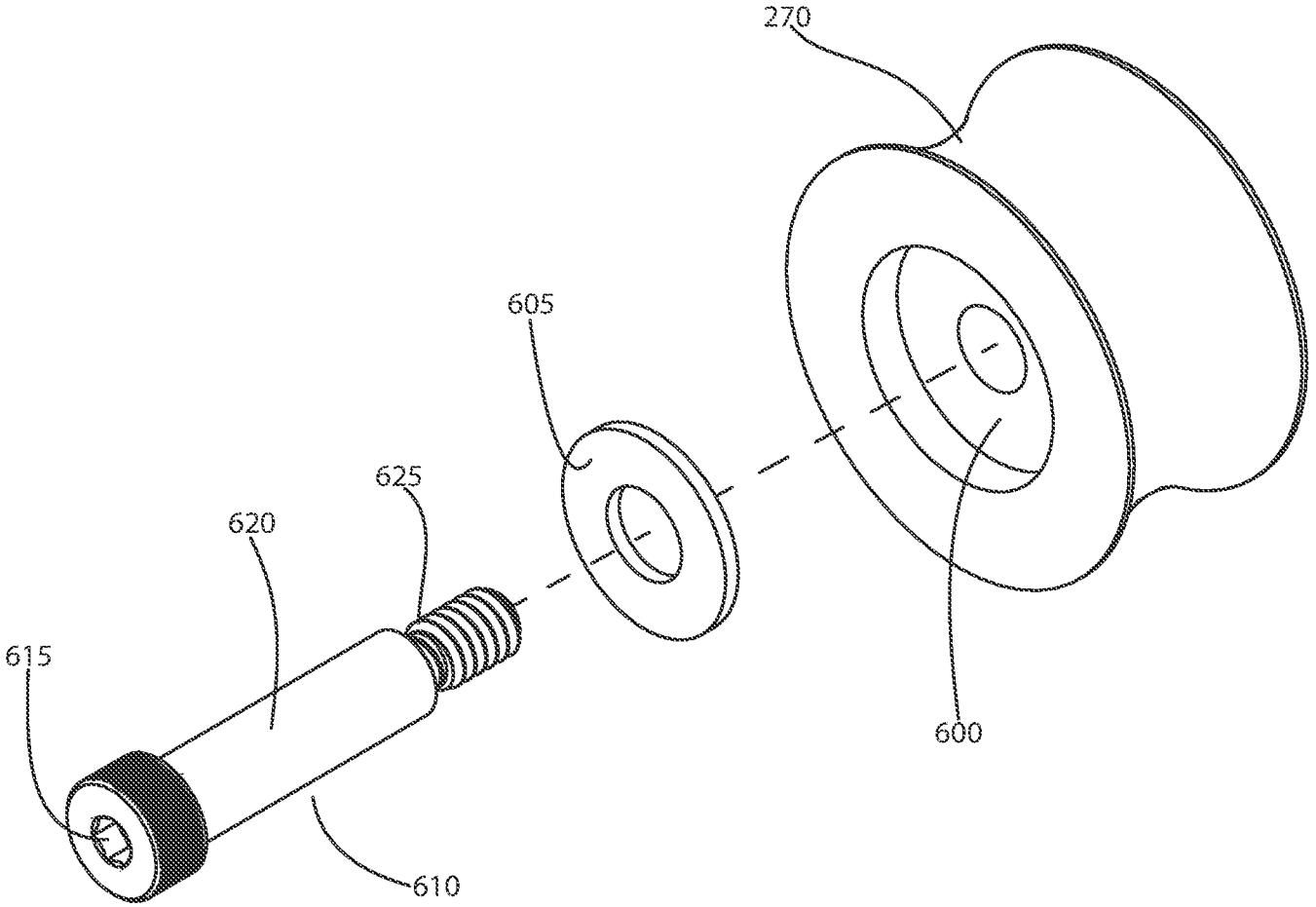
FIG. 9 is an exploded perspective view of a u-groove roller assembly for an exemplary exercise apparatus according to principles of the invention.

FIG. 9 provides an exploded perspective view of a u-groove roller assembly for an exemplary exercise apparatus according to principles of the invention. The roller includes a wheel with a U-groove surface 270, a bearing 600, a flat washer 605 and a shoulder screw 610. The shoulder screw 610 includes an unthreaded shoulder 620 between a head 615 and threaded shank 625. The wheel may be comprised of metal or plastic, such as nylon.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A two-person exercise machine comprising:

a pair of base rails including a first base rail and a second base rail, the first base rail being parallel to the second base rail;

a first seat assembly movably supported by the pair of base rails, the first seat assembly being movable along at least a first portion of the pair of base rails;

a second seat assembly movably supported by the pair of base rails, the second seat assembly being movable along at least a second portion of the pair of base rails, the second portion of the pair of base rails being spaced apart from the first portion of the pair of base rails;

a foot pad assembly disposed on the pair of bottom rails between the first seat assembly and the second seat assembly, the foot pad assembly including a first foot pad facing the first seat assembly and a second foot pad facing the second seat assembly;

a pair of upper rails, including a first upper rail and a second upper rail, the first upper rail being parallel to the second upper rail, and the pair of upper rails being supported at an upper elevation, and a first pair of rail supports extending from the pair of base rails to a first end of the pair of upper rails, and a second pair of rail supports extending from the pair of base rails to a second end of the pair of upper rails;

a handlebar assembly supported by the pair of upper rails between the first end of the pair of upper rails and the second end of the pair of upper rails, and the handlebar assembly including a first handlebar facing the first end of the pair of upper rails and a second handlebar facing the second end of the pair of upper rails.

2. The two-person exercise machine of claim 1, wherein the foot pad assembly is movable along at least an intermediate portion of the pair of base rails between the first seat assembly and the second seat assembly.

3. The two-person exercise machine of claim 1, wherein the first foot pad and the second foot pad each is at an acute angle relative to a plane bisecting the foot pad assembly.

4. The two-person exercise machine of claim 3, wherein a first angle of the first foot pad relative to the plane bisecting the foot pad assembly and a second angle of the second foot pad relative to the plane bisecting the foot pad assembly are complementary.

5. The two-person exercise machine of claim 1, further comprising a plurality of base rail supports, the plurality of base rail supports supporting the pair of base rails at an elevation, the elevation of the first base rail being equal to the elevation of the second base rail.

6. The two-person exercise machine of claim 5, wherein the plurality of base rail supports includes a first end bracket attached at a first end of the pair of bottom rails and a second end bracket attached at a second end of the pair of bottom rails, the first end being opposite the second end, and the first end bracket preventing movement of the first seat assembly beyond the first end, and the second end bracket preventing movement of the second seat assembly beyond the second end.

7. The two-person exercise machine of claim 1, wherein the first pair of rail supports extends from the pair of base rails between the first end of the pair of base rails and the foot pad assembly, and the second pair of rail supports extending from the pair of base rails between the second end of the pair of base rails and the foot pad assembly.

8. The two-person exercise machine of claim 1, wherein the handlebar assembly is movably supported by the pair of upper rails, and the handlebar assembly being movable between the first end of the pair of upper rails and the second end of the pair of upper rails.

9. The two-person exercise machine of claim 1, wherein the first upper rail is arcuate and the second upper rail is arcuate.

10. The two-person exercise machine of claim 1, wherein the first seat assembly includes a first plurality of rollers configured to engage and roll against the first base rail, and the first seat assembly includes a second plurality of rollers configured to engage and roll against the second base rail; and the second seat assembly includes a third plurality of rollers configured to engage and roll against the first base rail, and the second seat assembly includes a fourth plurality of rollers configured to engage and roll against the second base rail.

11. The two-person exercise machine of claim 10, wherein each of the first and third plurality of rollers includes upper and lower rollers, the upper rollers of the first and third plurality of rollers engaging and rolling against the first base rail, and the lower rollers of the first and third plurality of rollers engaging and rolling against the first base rail, the first base rail being disposed between the upper and lower rollers of the first and third plurality of rollers; and each of the second and fourth plurality of rollers includes upper and lower rollers, the upper rollers of the second and fourth plurality of rollers engaging and rolling against the second base rail, and the lower rollers of the second and fourth plurality of rollers engaging and rolling against the second base rail, the second base rail being disposed between the upper and lower rollers of the second and fourth plurality of rollers.

12. The two-person exercise machine of claim 1, wherein the foot pad assembly includes a fifth plurality of rollers configured to engage and roll against the first base rail, and the foot pad assembly includes a sixth plurality of rollers configured to engage and roll against the second base rail.

13. The two-person exercise machine of claim 12, wherein each of the fifth and sixth plurality of rollers includes upper and lower rollers, the upper rollers of the fifth plurality of rollers engaging and rolling against the first base rail, and the lower rollers of the fifth plurality of rollers engaging and rolling against the first base rail, the first base rail being disposed between the upper and lower rollers of the fifth plurality of rollers; and the upper rollers of the sixth plurality of rollers engaging and rolling against the second base rail, and the lower rollers of the sixth plurality of rollers engaging and rolling against the second base rail, the second base rail being disposed between the upper and lower rollers of the sixth plurality of rollers.

14. The two-person exercise machine of claim 8, wherein the handlebar assembly includes a seventh plurality of rollers configured to engage and roll against the first upper rail, and the handlebar assembly includes an eighth plurality of rollers configured to engage and roll against the second upper rail.

15. The two-person exercise machine of claim 12, wherein each of the seventh and eighth plurality of rollers includes upper and lower rollers, the upper rollers of the seventh plurality of rollers engaging and rolling against the first upper rail, and the lower rollers of the seventh plurality of rollers engaging and rolling against the first upper rail, the first upper rail being disposed between the upper and lower rollers of the seventh plurality of rollers; and the upper rollers of the eighth plurality of rollers engaging and rolling against the second upper rail, and the lower rollers of the eighth plurality of rollers engaging and rolling against the second upper rail, the second upper rail being disposed between the upper and lower rollers of the eighth plurality of rollers.

16. The two-person exercise machine of claim 1, wherein the foot pad assembly is movable along at least an intermediate portion of the pair of base rails between the first seat assembly and the second seat assembly; and the exercise machine further comprising a plurality of base rail supports, the plurality of base rail supports supporting the pair of base rails at an elevation, the elevation of the first base rail being equal to the elevation of the second base rail, the plurality of base rail supports including a first end bracket attached at a first end of the pair of bottom rails and a second end bracket attached at a second end of the pair of bottom rails, the first end being opposite the second end, and the first end bracket preventing movement of the first seat assembly beyond the first end, and the second end bracket preventing movement of the second seat assembly beyond the second end; and the first pair of rail supports extending from the pair of base rails between the first end of the pair of base rails and the foot pad assembly, and the second pair of rail supports extending from the pair of base rails between the second end of the pair of base rails and the foot pad assembly, the first upper rail being arcuate and the second upper rail being arcuate; and the handlebar assembly being movably supported by the pair of upper rails, and the handlebar assembly being movable between the first end of the pair of upper rails and the second end of the pair of upper rails; and the first seat assembly including a first plurality of rollers configured to engage and roll against the first base rail, and the first seat assembly including a second plurality of rollers configured to engage and roll against the second base rail; and the second seat assembly including a third plurality of rollers configured to engage and roll against the first base rail, and the second seat assembly including a fourth plurality of rollers configured to engage and roll against the second base rail; and each of the first and third plurality of rollers including upper and lower rollers, the upper rollers of the first and third plurality of rollers engaging and rolling against the first base rail, and the lower rollers of the first and third plurality of rollers engaging and rolling against the first base rail, the first base rail being disposed between the upper and lower rollers of the first and third plurality of rollers; and each of the second and fourth plurality of rollers including upper and lower rollers, the upper rollers of the second and fourth plurality of rollers engaging and rolling against the second base rail, and the lower rollers of the second and fourth plurality of rollers engaging and rolling against the second base rail, the second base rail being disposed between the upper and lower rollers of the second and fourth plurality of rollers; and the foot pad assembly including a fifth plurality of rollers configured to engage and roll against the first base rail, and the foot pad assembly including a sixth plurality of rollers configured to engage and roll against the second base rail; and each of the fifth and sixth plurality of rollers including upper and lower rollers, the upper rollers of the fifth plurality of rollers engaging and rolling against the first base rail, and the lower rollers of the fifth plurality of rollers engaging and rolling against the first base rail, the first base rail being disposed between the upper and lower rollers of the fifth plurality of rollers; and the upper rollers of the sixth plurality of rollers engaging and rolling against the second base rail, and the lower rollers of the sixth plurality of rollers engaging and rolling against the second base rail, the second base rail being disposed between the upper and lower rollers of the sixth plurality of rollers; and the handlebar assembly including a seventh plurality of rollers configured to engage and roll against the first upper rail, and the handlebar assembly including an eighth plurality of rollers configured to engage and roll against the second upper rail; and each of the seventh and eighth plurality of rollers including upper and lower rollers, the upper rollers of the seventh plurality of rollers engaging and rolling against the first upper rail, and the lower rollers of the seventh plurality of rollers engaging and rolling against the first upper rail, the first upper rail being disposed between the upper and lower rollers of the seventh plurality of rollers; and the upper rollers of the eighth plurality of rollers engaging and rolling against the second upper rail, and the lower rollers of the eighth plurality of rollers engaging and rolling against the second upper rail, the second upper rail being disposed between the upper and lower rollers of the eighth plurality of rollers.

17. The two-person exercise machine of claim 16, wherein each of the first base rail, the second base rail, the first upper rail and the second upper rail being comprised of tubular metal.

18. The two-person exercise machine of claim 16, wherein each of the first, second, third, fourth, fifth, sixth, seventh and eighth plurality of rollers comprising u-groove plastic rollers.

* * * * *